US008028761B2

(12) United States Patent
Meixner

(10) Patent No.: US 8,028,761 B2
(45) Date of Patent: Oct. 4, 2011

(54) ELECTRIC POWER TOOL

(75) Inventor: Gerhard Meixner, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 181 days.

(21) Appl. No.: 12/376,001

(22) PCT Filed: Jun. 13, 2007

(86) PCT No.: PCT/EP2007/055802

§ 371 (c)(1),
(2), (4) Date: Feb. 2, 2009

(87) PCT Pub. No.: WO2008/015050

PCT Pub. Date: Feb. 7, 2008

(65) Prior Publication Data

US 2009/0314506 A1 Dec. 24, 2009

(30) Foreign Application Priority Data

Aug. 2, 2006 (DE) ..... 10 2006 035 975

(51) Int. Cl.
*E21B 4/12* (2006.01)

(52) U.S. Cl. ..... 173/49; 173/201; 173/217

(58) Field of Classification Search ..... 173/47, 173/49, 110, 201, 211, 216, 217
See application file for complete search history.

(56) References Cited

U.S. PATENT DOCUMENTS

| | | | | |
|---|---|---|---|---|
| 1,139,139 | A * | 5/1915 | Smith | 173/110 |
| 1,921,628 | A * | 8/1933 | Maxwell et al. | 173/110 |
| 3,275,088 | A * | 9/1966 | Schrottle | 173/110 |
| 3,456,740 | A | 7/1969 | Paule et al. | |
| 3,463,246 | A | 8/1969 | Bronnert | |
| 4,066,136 | A * | 1/1978 | Wanner et al. | 173/48 |
| 4,113,035 | A | 9/1978 | Stiltz et al. | |
| 7,048,076 | B2 * | 5/2006 | Cecchin et al. | 173/201 |

FOREIGN PATENT DOCUMENTS

| | | |
|---|---|---|
| DE | 340541 | 9/1921 |
| DE | 3314414 A1 * | 10/1984 |
| GB | 1206853 | 9/1970 |

* cited by examiner

*Primary Examiner* — Sameh H. Tawfik
*Assistant Examiner* — Nathaniel Chukwurah
(74) *Attorney, Agent, or Firm* — Ronald E. Greigg

(57) ABSTRACT

The invention is based on an electric power tool having at least one drive unit and a gear unit, where the gear unit is a drive element for applying force to a piston unit. It is proposed that the drive element and the piston unit be arranged in an axially parallel manner. At least a region of the drive element overlaps axially with a longitudinal portion of the piston unit. The drive unit is arranged approximately centrally in an axial extension of the piston unit and the longitudinal axis of the drive unit is arranged transversely to the piston longitudinal axis.

1 Claim, 2 Drawing Sheets

ELECTRIC POWER TOOL

CROSS-REFERENCE TO RELATED APPLICATION

This application is a 35 USC 371 application of PCT/EP 2007/055802 filed on Jun. 13, 2007.

BACKGROUND OF THE INVENTION

1. Field of the Invention

The invention relates to an electric power tool.

2. Description of the Prior Art

Known electric power tools with an eccentric drive, in particular electric hammers, have a drive unit as well as a gear unit, and a rotary motion transmitted from the drive unit to a crankshaft via a drive shaft is converted into linear motions of a drive element, such as a connecting rod. In such electric hammers, a reciprocating barrel piston, connected to an eccentric element that is subjected to force by the connecting rod, is for instance used as the impact mechanism technology.

Typically, such electric power tools have a so-called "in-line" mode of construction, in which the eccentric element is disposed in-line axially before the drive unit. In this construction, the length of the connecting rod is included in the length of the device. This kind of construction can lead to a disadvantageous distribution of the weight of the device, because the device becomes top-heavy and can be manipulated only with difficulty.

ADVANTAGES AND SUMMARY OF THE INVENTION

In an electric power tool according to the invention, a drive unit and a piston unit are disposed axially parallel, and the drive element at least in some regions axially overlaps with a longitudinal extent of the piston unit, and the drive unit is disposed approximately centrally in an axial extension of the piston unit, and the longitudinal axis of the drive unit is disposed transversely to the longitudinal axis of the piston. With regard to the piston unit, the drive element is laterally offset, and a drive distance is shortened advantageously by the axial overlap. It is especially advantageous that the length of the drive element is not part of the definitive chain of mass for the structural length of the device. The structural length of the device is favorably shortened markedly as a result. This leads to a favorable compact, ergonomic structural form of the device. Further advantages are an ideal distribution of weight and better manipulation of the device.

In a first variant, a force transmission begins laterally at the piston unit. With unaltered effect, the piston unit is subjected to force via the drive element. The piston unit can preferably be embodied as a barrel piston. An embodiment as a cylindrical piston is also conceivable.

In a preferred embodiment, the drive unit axially follows the piston unit and is disposed "in a row" (or in-line) in an axial extension behind the piston unit. The drive unit can be disposed approximately centrally in the axial extension of the piston unit, and slight offsets of approximately ±20° are also possible. If the drive unit includes copper windings and an iron packet, then the copper windings and/or the iron packet of the drive unit overlap at least partially with the piston unit in an axial extension. This leads to an advantageous further shortening of the structural shape of the device, since with this arrangement, only the width of the drive unit, but not the total length of the drive unit, enters into the structural length of the device.

The drive element may include at least one connecting rod as well as a pivot pin, and the connecting rod is driven by an eccentric element. In this kind of crank drive, a rotary motion transmitted from a drive mechanism via a crankshaft can be converted into linear motions of the connecting rod. The eccentric element and the crankshaft can be coupled, for instance by means of toothing in the form of a gear wheel coupling. The connecting rod can in turn move a drive rod, which is axially guided and drives the piston unit.

In a second variant, the drive element may include a connecting link; favorably, the connecting link is disposed laterally on the circumference of the piston unit. Preferably, the connecting link is cast integrally with the piston unit, and the piston unit is favorably made from cast steel. However, some other connection between the connecting link and the piston unit is equally conceivable. An eccentric bolt is favorably guided in the connecting link, thereby moving the piston unit.

In an alternative variation, it can also be provided that the piston unit is driven directly by the connecting rod.

BRIEF DESCRIPTION OF THE DRAWINGS

Further embodiments and aspects of the invention will be described in further detail below in conjunction with drawings, regardless of how they are summarized in the claims, without restricting its general scope. In the drawings:

DESCRIPTION OF THE PREFERRED EMBODIMENTS

Figure 1:
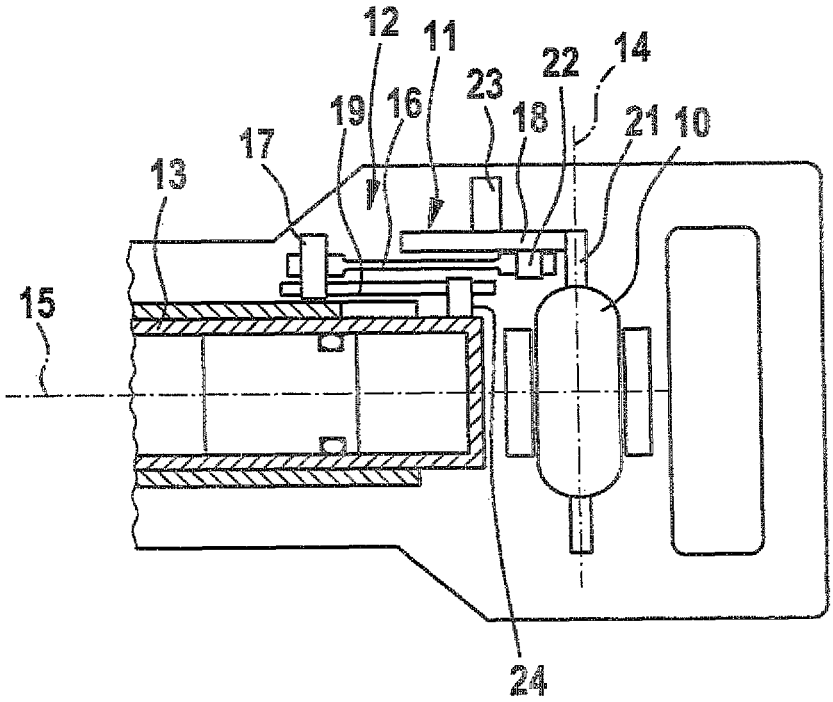
FIG. 1 shows a sectional view of a preferred embodiment of an electric power tool, with a one-speed gear and with an eccentric element drive with a connecting rod.

Identical elements are identified by the same reference numerals in the drawings.

FIG. 1 schematically shows a preferred embodiment of an electric power tool, with a drive unit 10 as well as a one-speed gear unit 11; the gear unit 11 includes a drive element 12 for subjecting a piston unit 13 to force. The drive element 12 and the piston unit 13 are disposed axially parallel, and the drive element 12, at least in some regions, overlaps axially with a longitudinal extent of the piston unit 13. The drive unit 10 is disposed approximately centrally in an axial extension of the piston unit 13, and a longitudinal axis 14 of the drive unit 10 is disposed transversely to the longitudinal axis 15 of the piston.

The drive unit 10 designed as an electric motor generates a rotary motion, which is transmitted via a drive shaft 21 to a crankshaft 23 of an eccentric element 18. The eccentric element 18 and the drive shaft 21 are coupled to one another by toothing, in the form of a gear wheel coupling, not shown in detail. In the conventional way, a pinion, not shown, can be fixed in a manner that prevents relative torque on the shank of the drive shaft 21; the pinion meshes with a gear ring, not shown. The eccentric element 18, in the known manner, converts the rotary motion of the drive unit 10 into linear motions of the drive element 12. The drive element 12 in FIG. 1 includes a connecting rod 16, and force transmission from the eccentric element 18 to the connecting rod 16 takes place via an eccentric bolt 22. The eccentric bolt 22 is embraced by an eye of the connecting rod 16. The linear reciprocating motion of the connecting rod 16 is transmitted via a pintle 17 to a drive rod 19. The drive rod 19 is disposed parallel to the connecting rod 16 and is guided axially. Via the drive rod 19, the piston unit 13 embodied as a barrel piston is driven. Via a force transmitting element 24, embodied on the circumference of the piston unit 13, the piston unit 13 is subjected to force.

The drive unit 10 is disposed axially behind the piston unit 13, and its axis of rotation is disposed perpendicular to the longitudinal axis 15 of the piston.

Figure 2:
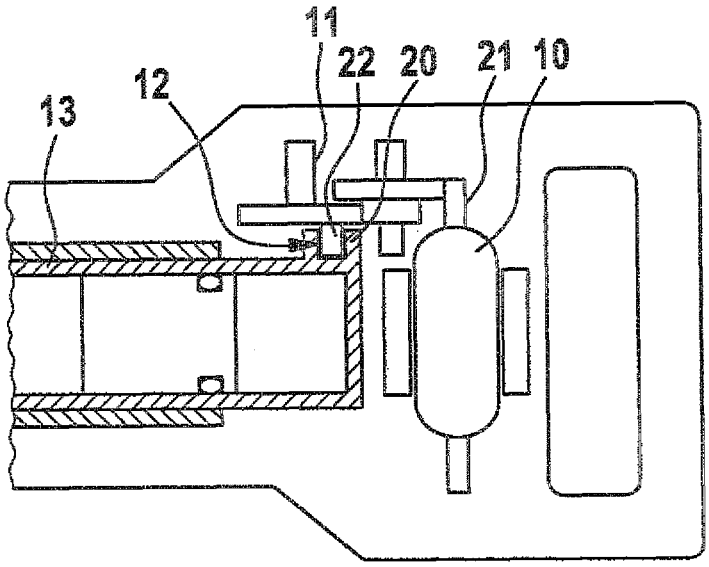
FIG. 2 shows a preferred variant in a sectional view, with a two-speed gear and a connecting link.
Figure 3:
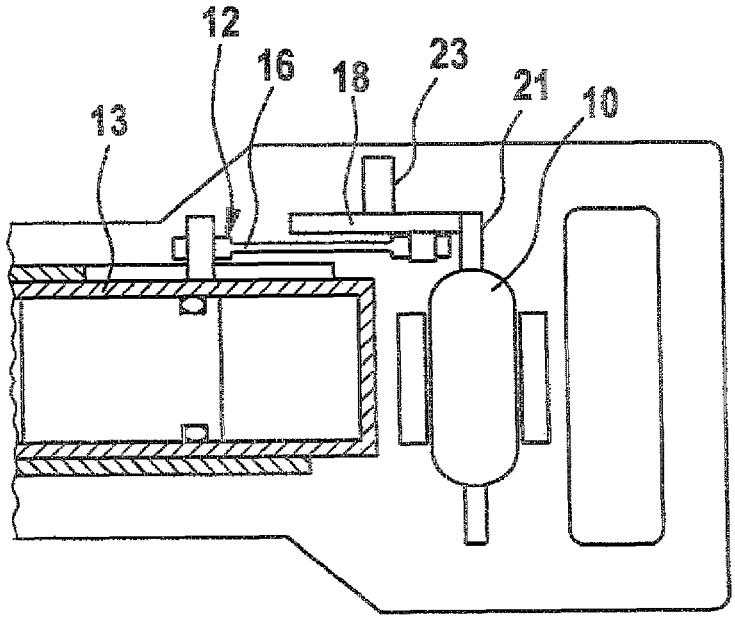
FIG. 3 is a sectional view of a further variant, in which a piston unit is driven directly via a connecting rod.
Figure 4:
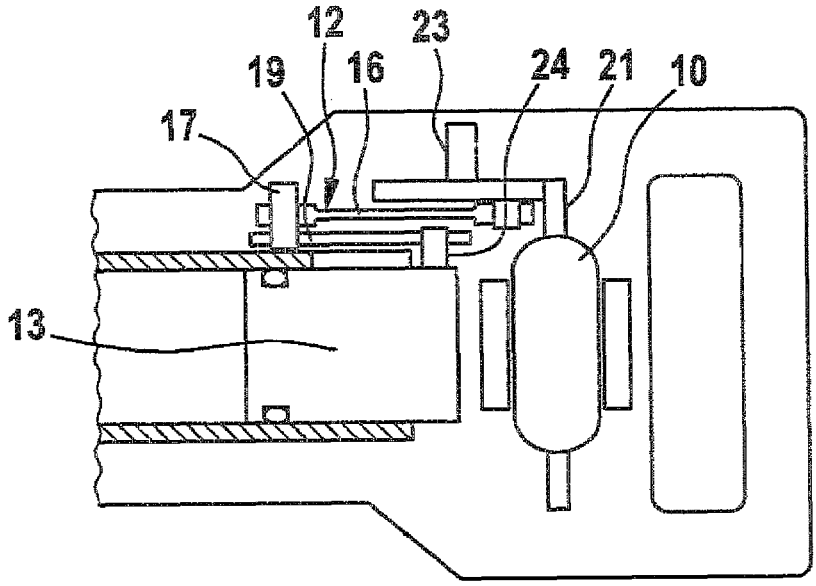
FIG. 4 is a sectional view of a further variant in which the piston unit is embodied as a cylindrical piston.

In FIGS. 2, 3 and 4, respective alternative embodiments of an electric power tool according to the invention are shown. The mode of operation of the drive mechanism is essentially equivalent to the description of FIG. 1, which is referred to in each case to avoid repetition.

In a distinction from the embodiment shown in FIG. 1, the view in FIG. 2, besides a drive unit 10, includes a two-speed gear unit 11. The drive element 12 includes a connecting link 20, which is disposed laterally on the circumference of the piston unit 13, and in particular is cast integrally with the piston unit 13. Conversion of the motion in the connecting link 20 is effected via the eccentric bolt 22, which runs in the connecting link 20 of the piston unit 13, as a result of which the piston unit 13 is driven.

In FIG. 3, a further variant is shown, in which the piston unit 13 is driven directly by a connecting rod 16, and the drive rod is omitted.

The variant shown in FIG. 4 is essentially equivalent to what is shown in FIG. 1. In a distinction from that, the piston unit 13 includes a cylindrical piston.

The foregoing relates to the preferred exemplary embodiments of the invention, it being understood that other variants and embodiments thereof are possible within the spirit and scope of the invention, the latter being defined by the appended claims.

The invention claimed is:

1. An electric power tool comprising at least one drive unit and a gear unit, the gear unit including a drive element which drives a piston unit, the drive element and the piston unit being disposed axially parallel to one another, wherein at least in some regions the drive element overlaps axially with at least a longitudinal portion of the piston unit, the drive unit is disposed approximately centrally in an axial extension of the piston unit, and a longitudinal axis of the drive unit is disposed transversely to a longitudinal axis of the piston, wherein said drive element includes a connecting rod, said connecting rod is attached to an eccentric element which drives it and, wherein said connecting rod is also attached to a drive rod such that said drive rod is moved by said connecting rod.

* * * * *